US008803425B2

(12) United States Patent
Lotti et al.

(10) Patent No.: US 8,803,425 B2
(45) Date of Patent: Aug. 12, 2014

(54) DEVICE FOR GENERATING PLASMA AND FOR DIRECTING AN FLOW OF ELECTRONS TOWARDS A TARGET

(75) Inventors: Riccardo Lotti, Bologna (IT); Petr Nozar, San Lazzaro di Savena (IT); Carlo Taliani, Bologna (IT)

(73) Assignee: Organic Spintronics S.r.l. (IT)

( * ) Notice: Subject to any disclaimer, the term of this patent is extended or adjusted under 35 U.S.C. 154(b) by 66 days.

(21) Appl. No.: 13/259,953

(22) PCT Filed: Mar. 23, 2010

(86) PCT No.: PCT/IB2010/000644
§ 371 (c)(1),
(2), (4) Date: Dec. 12, 2011

(87) PCT Pub. No.: WO2010/109297
PCT Pub. Date: Sep. 30, 2010

(65) Prior Publication Data

US 2012/0081006 A1 Apr. 5, 2012

Related U.S. Application Data

(60) Provisional application No. 61/181,815, filed on May 28, 2009.

(30) Foreign Application Priority Data

Mar. 23, 2009 (IT) ..... B02009A0167

(51) Int. Cl.
*H01J 7/24* (2006.01)

(52) U.S. Cl.
USPC ..... 315/111.21; 315/111.41; 315/111.81

(58) Field of Classification Search
USPC ..... 315/111.21, 13, 39
See application file for complete search history.

(56) References Cited

U.S. PATENT DOCUMENTS 5,302,881 A * 4/1994 O'Loughlin ..... 315/111.21
5,576,593 A 11/1996 Schultheiss et al.

(Continued)

FOREIGN PATENT DOCUMENTS

EP 0463705 A1 1/1992
WO WO-2006/105955 A2 10/2006

OTHER PUBLICATIONS

Nakagawa et al, Production of Pulse high density electron beam by channel spark discharge, Transactions of the institue of electrical engineers of Japan Part A vol. 120 A No. 4 Apr. 2000 pp. 391-397 XP 002553605.*

(Continued)

*Primary Examiner* — Douglas W Owens
*Assistant Examiner* — Srinivas Sathiraju
(74) *Attorney, Agent, or Firm* — Schwegman, Lundberg & Woessner, P.A.

(57) ABSTRACT

Various embodiments include a device for generating plasma and for directing an flow of electrons towards a specific target; the device comprises a hollow cathode; a main electrode at least partially placed inside the cathode; a resistor, electrically earthing the main electrode; a substantially dielectric tubular element extending through a wall of the cathode; a ring-shaped anode placed around the tubular element and earthed; and an activation group which is electrically connected to the cathode and is able to reduce the electric potential of the cathode of at least 8 kV in about 10 ns.

16 Claims, 8 Drawing Sheets

(56) References Cited

U.S. PATENT DOCUMENTS

| | | | | |
|---|---|---|---|---|
| 5,917,286 | A * | 6/1999 | Scholl et al. | 315/111.21 |
| 6,049,162 | A * | 4/2000 | Schultheiss et al. | 313/231.01 |
| 6,066,901 | A * | 5/2000 | Burkhart et al. | 307/106 |
| 7,589,473 | B2 * | 9/2009 | Suslov | 315/111.21 |
| 7,872,406 | B2 * | 1/2011 | Matacotta | 313/231.31 |
| 8,030,849 | B2 * | 10/2011 | Suslov | 315/111.21 |
| 2005/0012441 | A1 | 1/2005 | Schulteiss | |
| 2009/0246116 | A1 * | 10/2009 | Dediu et al. | 423/447.3 |

OTHER PUBLICATIONS

T.Witke et al Channel spark discharges for thin film technology I EEE XVIIth International symposium on discharges and insulations nsulations in vacuum Berkeley 1996 p. 1009-1013.*

"International Application Serial No. PCT/IB2010/000644, International Search Report mailed Oct. 5, 2010", 4 pgs.

"International Application Serial No. PCT/IB2010/000644, Written Opinion mailed Oct. 5, 2010", 6 pgs.

Krasik, Y. E., et al., "Characterization of a channel spark discharge and the generated electron beam", *Journal of Applied Physics*, 99(6), (2006), 063303-1-063303-14.

Nakagawa, Y., et al., "Production of a Pulsed High-Density Electron Beam by Channel Spark Discharge", *Electrical Engineering in Japan*, 134(4), (Translated from Denki Gakkai Ronbunshi, vol. 120-A, No. 4, Apr. 2000, pp. 391-397), (2001), 10-18.

Ozur, G. E., et al., "Formation of Narrow Low-Energy High-Intensity Electron Beams", *Technical Physics*, 53(7), (2008), 919-926.

* cited by examiner

DEVICE FOR GENERATING PLASMA AND FOR DIRECTING AN FLOW OF ELECTRONS TOWARDS A TARGET

PRIORITY CLAIM AND RELATED APPLICATIONS

This application is a nationalization under 35 U.S.C. 371 of PCT/IB2010/000644, filed Mar. 23, 2010 and published as WO 2010/109297 A2 on Sep. 30, 2010, which claims priority to Italian Patent Office Application No. BO 2009A 000167, filed Mar. 23, 2009; and to U.S. Provisional Patent Application No. 61/181,815, filed May 28, 2009; which applications and publication are incorporated herein by reference in their entirety.

TECHNICAL FIELD

The present invention concerns a device for generating plasma, an apparatus comprising such a device and a method for applying a layer of a material on a support.

Pulsed flows of electrons are presently used for applying thin layers of specific materials on substrates. This kind of technique finds now a particularly advantageous application in the electronic field, for the production of microchips.

BACKGROUND ART

Different experimental systems for generating pulsed flow of electrons for producing thin layers are already known. However, as far as we know, only two systems have found an industrial application. These systems are based upon a process called Channel Spark Ablation. In these systems the flow generation occurs by extracting electrons from a plasma generated in a rarefied gas by applying a not elevated difference of potential (lower than 30 kV).

Examples of known devices using the process of Channel Spark Ablation are illustrated in FIGS. 8 and 9, and are disclosed in the patent application with the publication number WO2006/105955A2. In particular, the known devices A comprise a metal cathode B, which has a hollow cylindrical shape and is electrically connected to an electric feeder C; a sealed ampoule D made of dielectric material (glass and/or ceramics) and connected to the cathode B; and an auxiliary electrode E placed inside (FIG. 8) or outside (FIG. 9) the ampoule D. The devices A further comprise a capillary F, which is made of a dielectric material and protrudes from the cathode B on the opposite side with regard to the ampoule D; and an anode G, which is ring-shaped and is placed outside the cathode B, around the capillary F.

In use, the cathode B is kept at a relatively high negative electric potential (namely, with a negative charge); when an electric pulse is produced on the auxiliary electrode E (e.g. by earthing said electrode), a glow discharge is created which, on its turn, generates a positive electric charge inside the cathode B. The positive electric charge is compensated by the emission of electrons, which are then accelerated toward the anode G inside the capillary F. The electrons, during their motion towards the outside, ionize further molecules, thus producing further electrons (called secondary electrons). The electrons produced inside the cathode B and the secondary electrons are sent from the capillary G towards a target H.

The known devices of the aforesaid kind have several disadvantages, among which, for instance:

- the devices are relatively elongated, and therefore bulky, because of the presence both of the ampoule F and of the cathode B;

- the devices can be relatively easily damaged; the ampoule D is made of a dielectric material much more fragile than other components made of metallic material;
- the devices are difficult to produce; the fluid tight insertion of the auxiliary electrode E into the ampoule D is very difficult because of the fragility of the ampoule D;
- the devices emit low-density flow of electrons (the density is particularly low when the auxiliary electrode E is placed outside the ampoule D); this causes a relevant increase of the production time of thin layers;
- the devices are hardly controllable: considering that the cathode B is kept charged for long periods, it is possible the development of spontaneous discharges between the cathode B and the anode G.

The article by NAKAGAMA ET AL ("Production of pulse high density electron beam by channel spark discharge" TRANSACTIONS OF THE INSTITUTE OF ELECTRICAL ENGINEERS OF JAPAN, PART A INST. ELECTR. ENG JAPAN, vol. 120-A, no. 4, April 2000 (2000-04), pages 391-397, XP002553605 ISSN: 0385-4205) discloses a device analogous to the devices described above which has, again, all the mentioned drawbacks. In particular, the device of the cited article comprises a brass tubular cathode fitted on a glass ampoule; and an auxiliary electrode placed inside the ampoule completely outside of the cathode. This device uses the so called "hollow cathode discharge" (page 11, second column, line 6); in other words, inside the ampoule a glow discharge is produced, which glow discharge has a low density of electrons.

The structure, the functioning and the disadvantages of the device disclosed by the patent application having publication number US2005/012441 are analogous to those indicated above.

DISCLOSURE OF INVENTION

The aim of the present invention is to provide a device for generating plasma, an apparatus and a method for applying a layer of a material on a support, which allow to overcome, at least partially, the disadvantages of the known prior art and are, at the same time, easy and cheap to produce.

According to the present invention there are provided a device for generating plasma, an apparatus and a method for applying a layer of a material on a support according to what recited in the annexed independent claims and, preferably, in any one of the claims directly or indirectly dependent on the independent claims.

BRIEF DESCRIPTION OF THE DRAWINGS

The invention is hereinafter described with a reference to the annexed drawings, illustrating some non limiting embodiments, wherein.

BEST MODE FOR CARRYING OUT THE INVENTION

Figure 1:
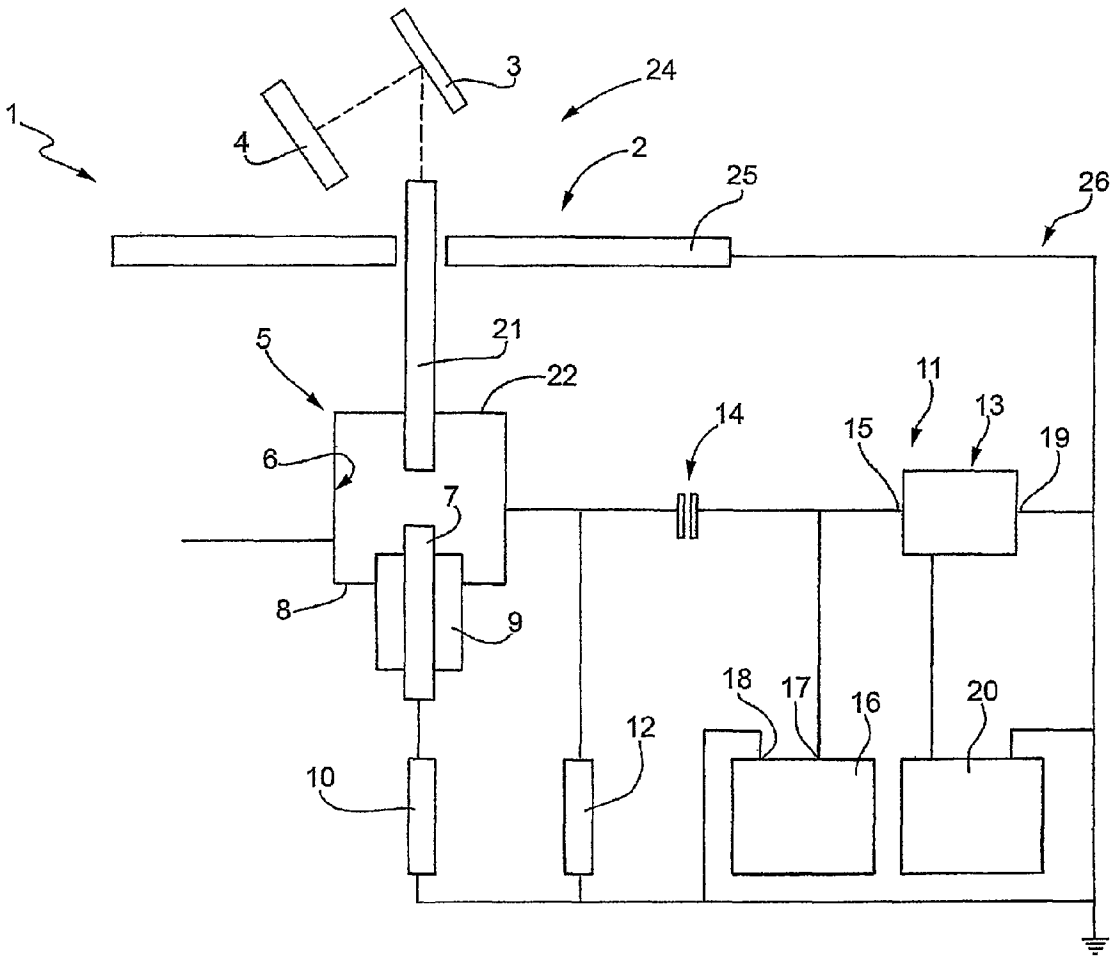
FIG. 1 schematically shows an apparatus and a device according to the present invention.

Number 1 in FIG. 1 indicates as a whole an apparatus for laying down a specific material. The apparatus 1 comprises a device 2 for generating plasma (i.e. an at least partial ionization of a rarefied gas) and for directing the flow of electrons towards a target 3, which has (in particular, is made of) the specific material, so that at least a part of the specific material is detached from the target 3 and lays down on a support 4.

According to alternative embodiments, the specific material can be formed by a single homogeneous material or by the combination of two or more different materials.

Advantageously, the target 3 is earthed. In this way, the target 3 does not repel (and in fact attracts) the flow of electrons even when the electrons have already hit the target 3.

The device 2 comprises a hollow element 5, which acts as a cathode and has (externally delimits) an internal cavity 6; and a main electrode 7, which comprises (in particular, is made of) metallic (in particular, substantially electrical conductive) material and is arranged inside the cavity 6 (delimited by the hollow element 5). In particular, the hollow element 5 comprises (more particularly, is made of) a metal material (more particularly, substantially electrical conductive). According to some embodiments, the hollow element comprises (in particular, is made of) a material selected in the group consisting of: stainless Steel, Tungsten, Molybdenum, Chrome, Iron, Titanium. According to some embodiments, the main electrode 7 comprises (in particular, is made of a material selected in group consisting of: stainless Steel, Tungsten, Molybdenum, Chrome, Iron, Titanium.

According to the embodiment depicted in FIG. 1, the main electrode 7 extends through a wall 8 of the hollow element 5. Between the main electrode 7 and the wall 8 it is interposed a ring 9 of substantially dielectric material (in particular ceramics).

Furthermore, the device 2 comprises a resistor 10 earthing the main electrode 7 and having a resistance of at least 100 Ohm, advantageously at least 1 kOhm. In particular, the resistor 10 has a resistance of about 20 kOhm.

According to further embodiments, another electronic device having an equivalent function is used instead of the resistor 10.

A rarefied gas is present inside the cavity 6. According to some embodiments, the cavity contains rarefied gas at a pressure lower than or equal to $10^{-2}$ mbar. Advantageously, the rarefied gas contained inside the cavity 6 shows a pressure comprised between $10^{-2}$ and $10^{-5}$ mbar, specifically about $10^{-3}$ mbar.

In this regard, please note that the apparatus 2 comprises a gas feed assembly (per se known and not shown) to feed an anhydrous gas (non limiting example—oxygen, nitrogen, argon, helium, xenon, etc.) inside the cavity 6; and a suction assembly (per se known and not shown) comprising a pump and able to rarefy the gas in the cavity (in other words, to reduce the gas pressure inside the cavity 6). The feed and suction assemblies are connected to the hollow element 5 by means of a duct 23.

The hollow element 5 is electrically connected to an activation group 11, which is able to reduce the electric potential of the hollow element 5 of at least 8 kV (in particular, starting from an electric potential substantially equal to zero) in less than 20 ns, sending an electric pulse with a charge of at least 0.16 mC to the hollow element. According to some embodiments, the aforesaid electric pulse is lower than or equal to 0.5 mC.

Therefore, in use, the activation group 11 imposes a difference of potential between the hollow element 5 and the main electrode 7 according to the aforesaid parameters. As a consequence, some plasma is generated (namely an at least partial ionization of the rarefied gas) inside the cavity 6.

Advantageously, the activation group 11 is able to impose on the hollow element 5 a potential decrease from 8 kV to 25 kV in less than 15 ns, in particular about 10 ns.

With a particular reference to what shown in FIG. 1, the hollow element 5 is earthed. In this way, when the emission of the flow of electrons is not carried out, the hollow element is kept at a substantially null potential and the danger of spontaneous discharges between the hollow element 5 and the main electrode 7 is substantially avoided.

In particular, a resistor 12 is connected between the hollow element 5 and the earth. According to some embodiments, the resistor 12 has a resistance of at least 50 kOhm. Advantageously, the resistor 12 has a resistance of at least 100 kOhm, in particular about 0.5 MOhm. According to some embodiments, the resistance is lower than 1 MOhm.

According to further embodiments, another electronic device having equivalent function is used instead of the resistor 12.

According to the embodiment shown in FIG. 1, the activation group 11 comprises a thyratron 13; a condenser 14, which has a frame connected to an anode 15 of the thyratron 13 and a further frame connected to the hollow element 5; and an electric feeder 16, which has a positive electrode 17 electrically connected to the anode 15 and an earthed negative electrode 18.

Furthermore, the thyratron 13 has a cathode 19 which is earthed.

The activation group 11 also comprises a control unit 20 of the thyratron 13, which control unit 20 can operate the thyratron 13 and is earthed.

According to embodiments which are not shown, the activation group 11 comprises a magnetic compressor of the electric pulse or a Blumlein high-potential electric pulse generator. Advantageously, the magnetic compressor (or the pulse generator) replaces the thyratron 13 and the relative control unit 20.

The device 2 further comprises an operator interface group (already known and therefore not illustrated), which allows an operator to adjust the operation (for instance the operation and/or the modification of working parameters) of the device 2. In particular, the operator interface group comprises a personal computer, a display, a keyboard and/or a pointing device (e.g. a mouse). The operator interface group is connected to the control unit 20.

According to further embodiments, another electronic device having an equivalent function is used instead of the condenser 14.

Moreover, the device 2 comprises a tubular element 21, which is made of a substantially dielectric material (in particular glass) and extends through a wall 22 of the hollow element 5 opposed to the wall 8 partially inside the cavity 6 and partially inside an external chamber 24. The tubular element 21 has an internal lumen connecting the cavity 6 to the external chamber 24, wherein the target 3 and the supporting element 4 are placed. The tubular element 21 and the relative internal lumen have respective substantially circular cross sections.

According to specific embodiments, the tubular element 21 has a length from 90 mm to 220 mm. The tubular element has a diameter from about 5 mm to about 7 mm. The internal lumen of the tubular element 21 has a diameter from about 2 mm to about 4 mm. the other components of the device 2 have substantially proportional (with respect to the dimensions of the tubular element 21) according to what shown in FIG. 4.

The external chamber 24 is built in such a way that it is fluid-tight with regard to the external environment.

The device 2 further comprises an external element 25, which is placed in the external chamber 24 along the tubular element 21 (i.e. not in correspondence to an end of the tubular element 21) and acts as an anode. In particular, the external element 25 is in contact with an external surface of the tubular element 21.

In use, when electrons formed inside the cavity 6 enter the tubular element 21, the difference of potential established with the external element 25 allows the electrons to be accelerated along the tubular element 21 towards the target 3. During their motion, these electrons hit further gas molecules and therefore determine the emission of secondary electrons which, on their turn, are accelerated towards the target 3.

The device 2 further comprises a potential maintenance group 26, which is electrically connected to the external element 25 to keep the electric potential of the external element 25 substantially equal to or higher than zero. In particular, the potential maintenance group 26 substantially earths the electric potential of the external element 25.

The external element 25 is shaped so that it is placed around the tubular element 21; in particular, the external element 25 has a hole, through which the tubular element 21 extends. According to specific embodiments, the external element 25 is ring-shaped.

Figure 2:
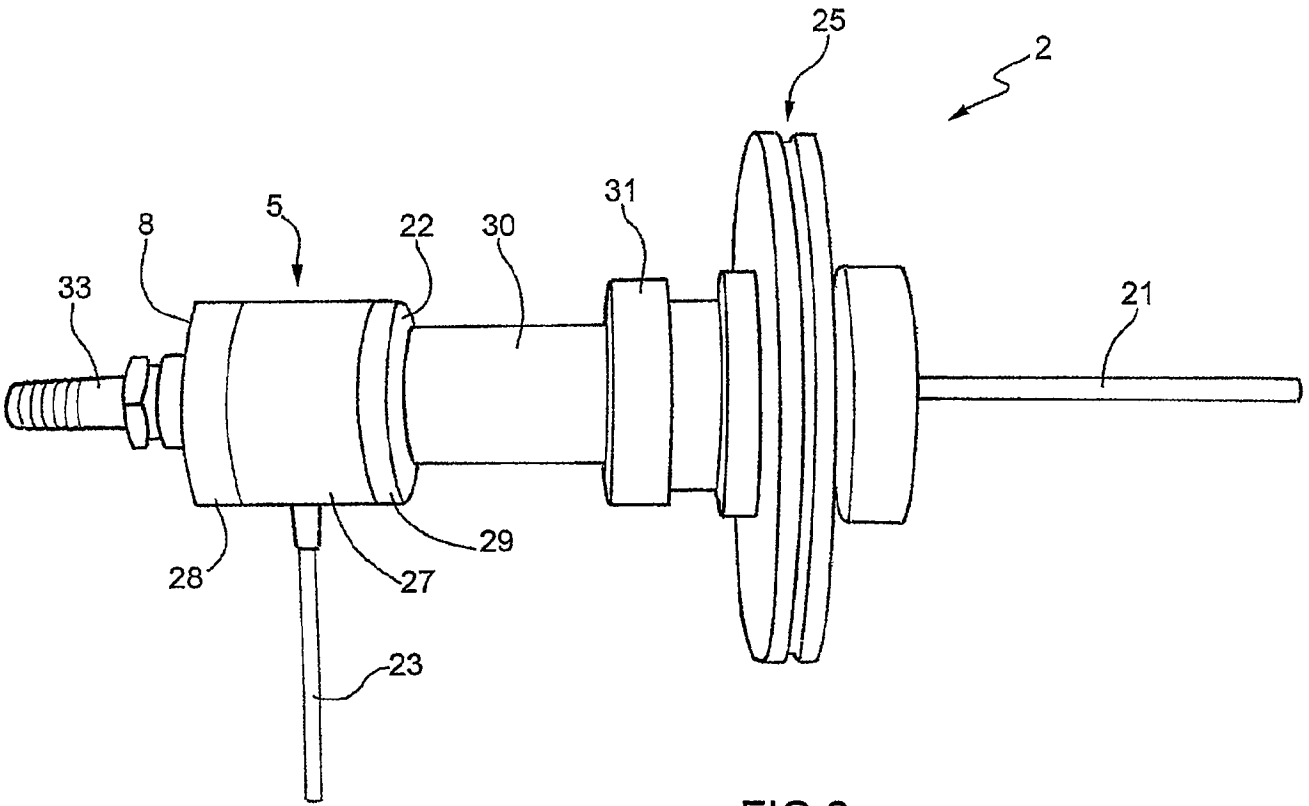
FIG. 2 is a perspective side view of a part of a device according to the present invention.
Figure 3:
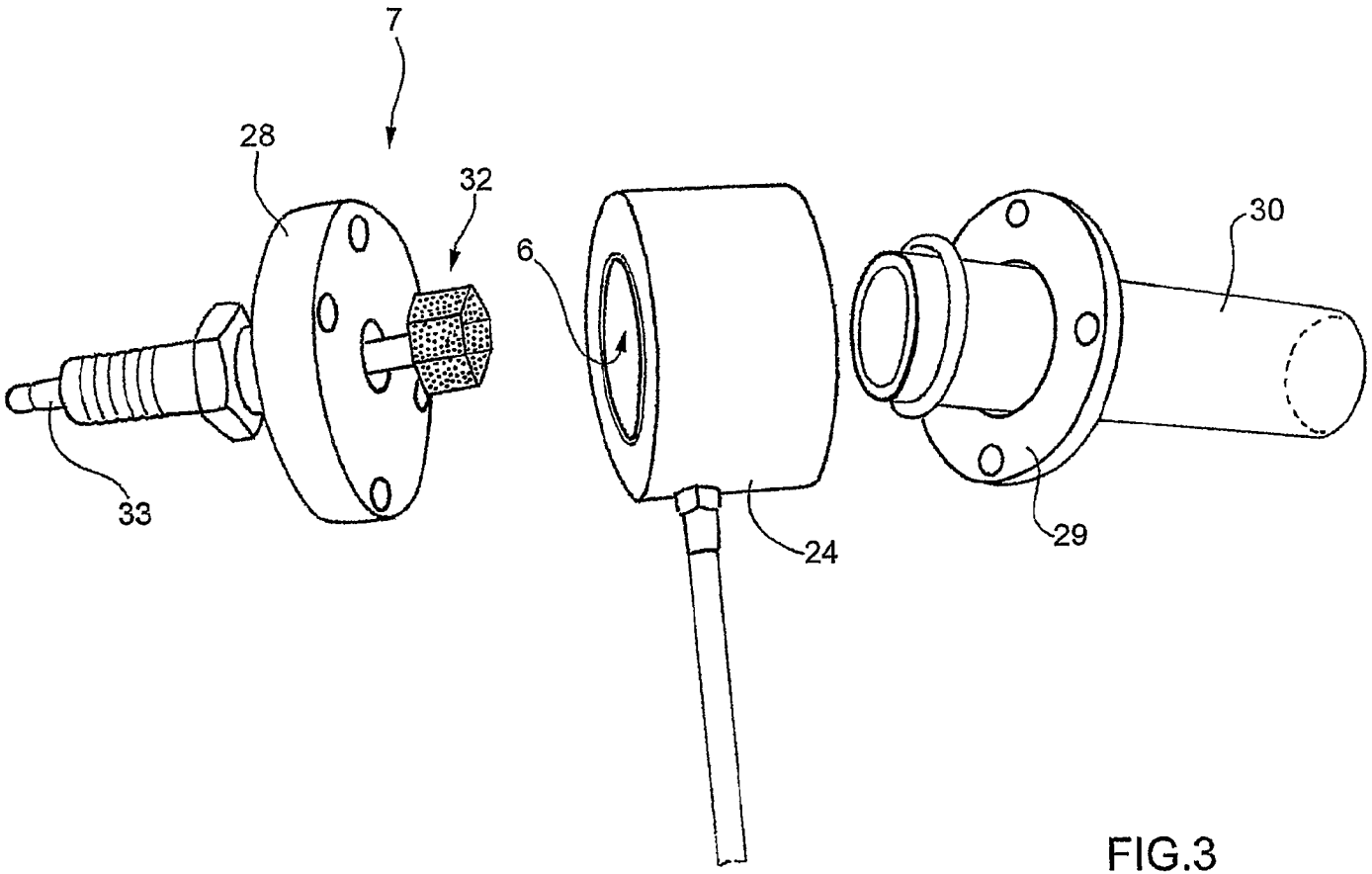
FIG. 3 is a perspective view of disassembled components of the device of FIG. 2.
Figure 4:
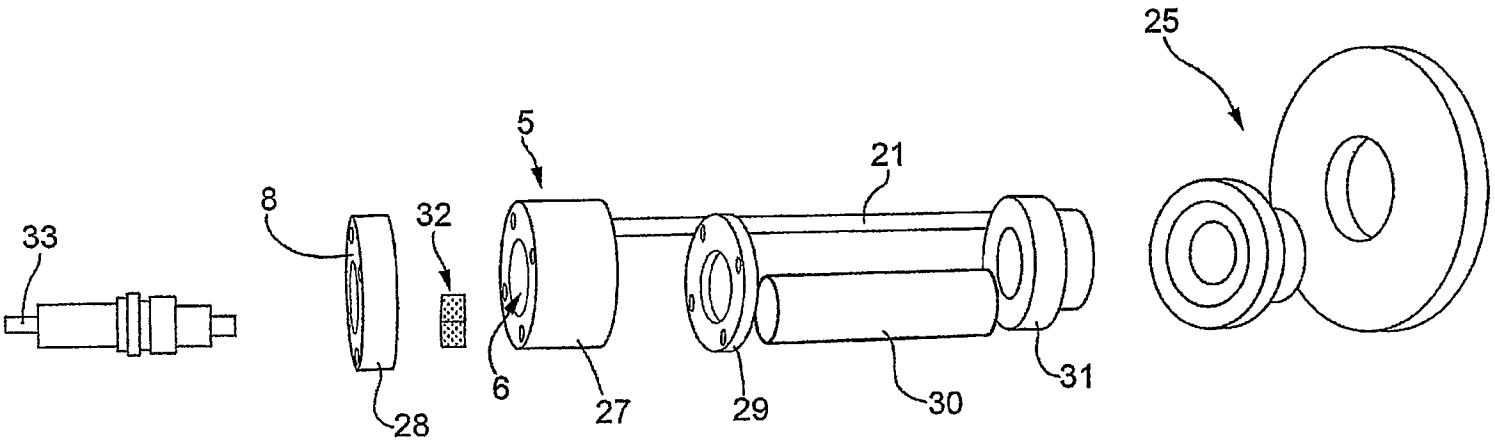
FIG. 4 is a perspective side view of disassembled components of the device of FIG. 2.

With a particular reference to FIGS. 2, 3 and 4, the hollow element 5 has a substantially cylindrical shape having a substantially circular section and, advantageously, is obtained by mounting two drilled plates 28 and 29 which, once mounted, define walls 8 and 9, respectively.

With a reference to FIGS. 2, 3 and 4, the device 2 further comprises a tube 30, which is made of a dielectric material (in particular glass or alumina), and is placed around a section of the tubular element 21 for mechanically connecting the hollow element 5 and the external element 25. Between the tube 30 and the external element 25 it is interposed a ring 31 made of a polymeric material.

Figure 5:
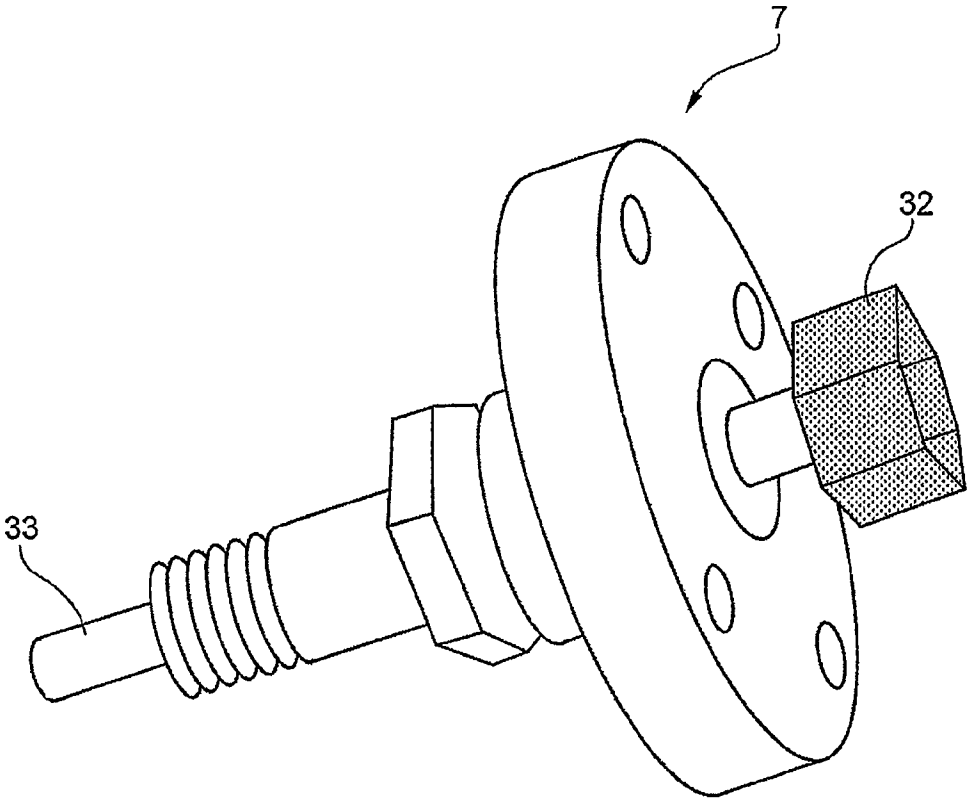
FIG. 5 is a perspective view of a component (the main electrode) of the device of FIG. 2.

With a reference to FIGS. 3, 4 and 5, the main electrode 7 has a web shaped end 32 made of metallic material and earthed by means of an electrical connection HV 33.

Figure 6:
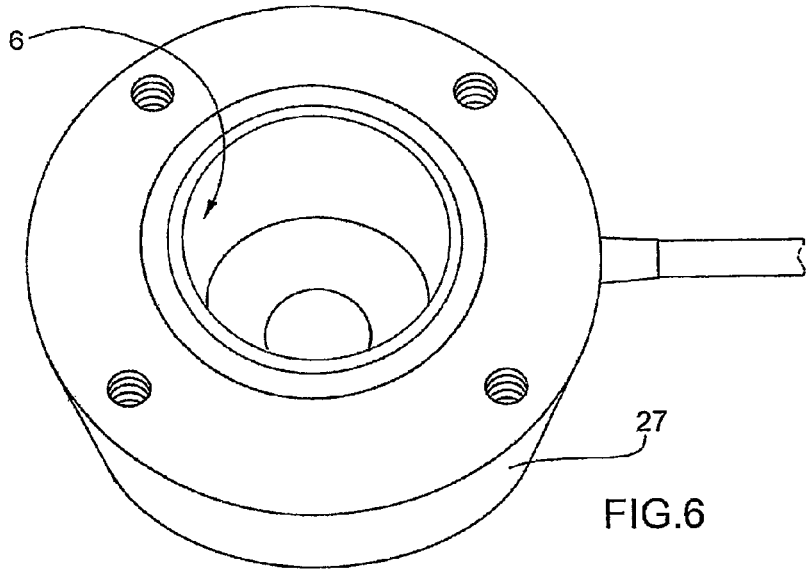
FIGS. 6 and 7 are prospective views of opposed sides of a component (the cathode) of the device of FIG. 2.
Figure 7:
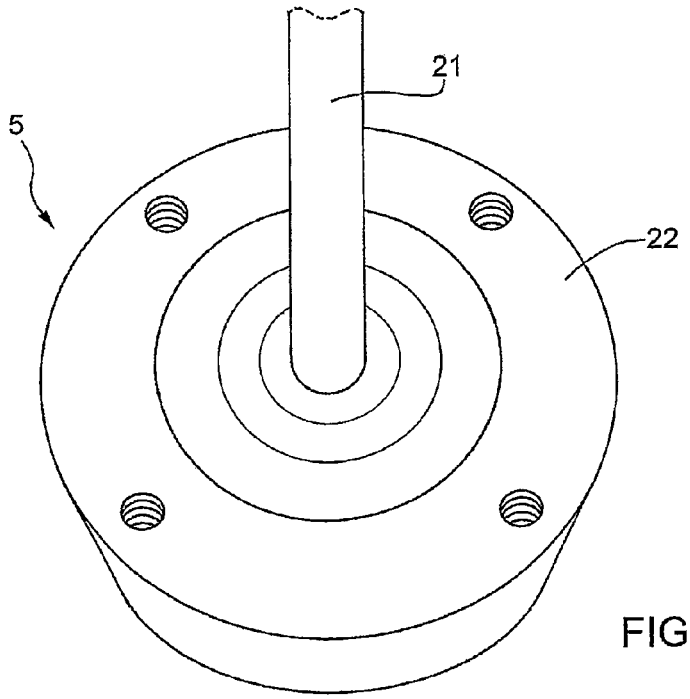
Figure 8:
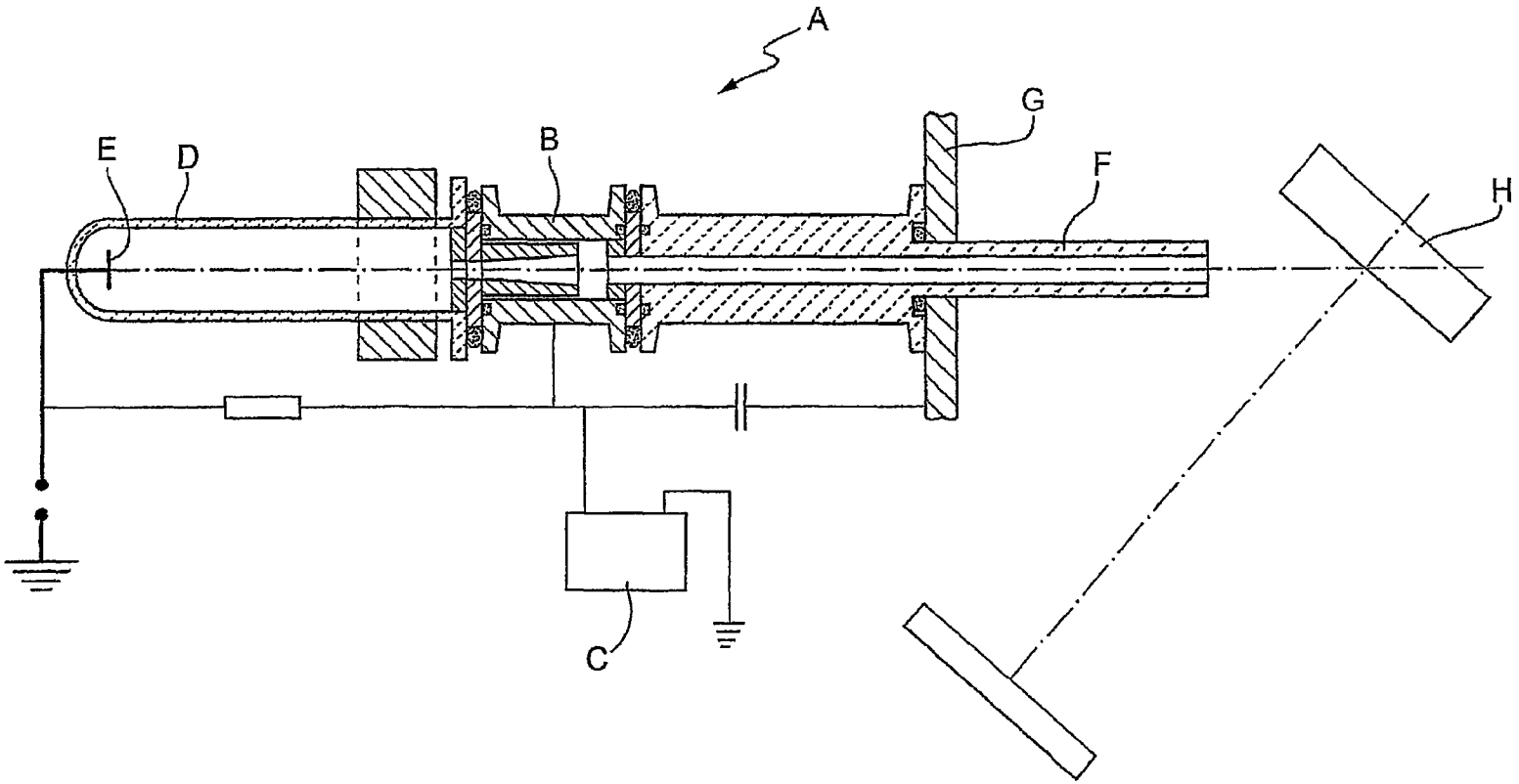
FIGS. 8 and 9 show devices belonging to the prior art.
Figure 9:
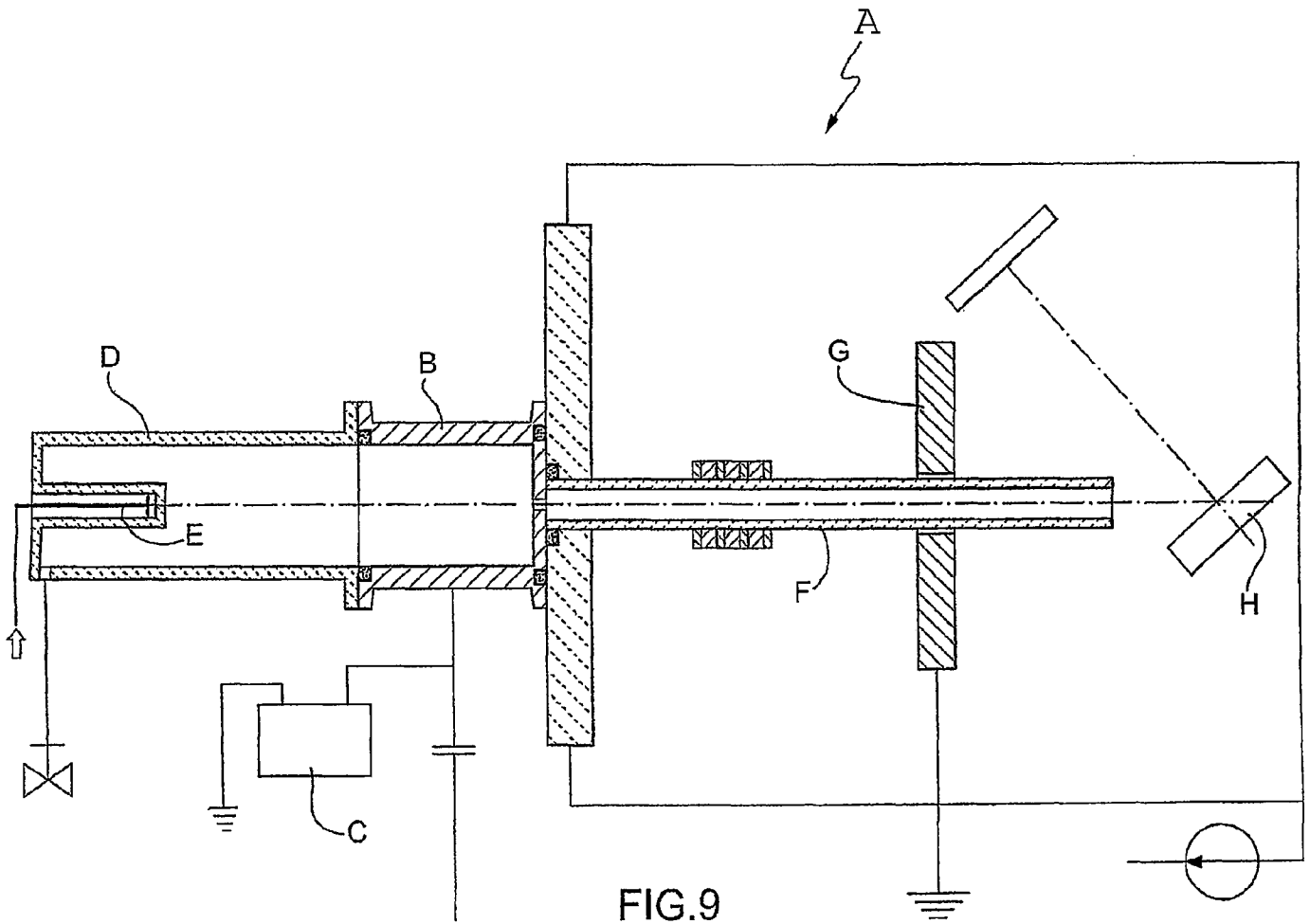

FIGS. 6 and 7 show, respectively, the inside of cavity 6 and the connection between the hollow element 5 and the tubular element 21.

It is important to point out that the different components of the device 2 are tightly connected to each other by interposing suitable gaskets.

In use, when the activation group 11 induces the electric pulse on the hollow element 5, the electric potential of the external element 25 is lowered to the earth potential in about 10-20 ns. The hollow element 5 is in a "floating" condition for such short intervals of time. This leads to a very rapid decrease of the electric potential of the hollow element 5.

As a consequence, an arc lights between an internal surface of the cavity 6 and the main electrode 7. The plasma of the arc expands inside the tubular element 21 and lights the discharge of the canalized spark which, on its turn, produces a high-energy flow of electrons.

It is important to remark that it can be experimentally observed that the device 2 according to the present invention can produce a particularly dense plasma and, therefore, a very intense flow of electrons (in particular, more intense than those obtainable by means of the known devices—this determines a relevant increase of the production times of thin layers). In particular, it has been experimentally observed that device 2 in accordance with the present invention is capable of producing a plasma with a density of approximately $10^{17}$ electrons/$cm^3$, whereas, on the other hand, the known devices (such as those disclosed in WO2006/105955A2, US2005/012441A1 and in the cited article by NAKAGAWA Y ET AL.) produce a plasma with a density of about $10^9$ electrons/$cm^3$.

The device in accordance with the present invention has, thus, an efficacy and an efficiency surprisingly higher with respect to the known devices.

In particular, it has been experimentally observed that at the beginning of the process a high-energy electron pulse having a duration of about 50 ns is generated (controlled by the acceleration voltage or by the charging voltage of condensers). The thus produced electrons are led and sent by means of the tubular element 21 towards the target 3. At this point, the electric current between the hollow element 5 and the target 3 disappears, then increasing again as a consequence of the short circuit created between the hollow element 5 and the target 3 by means of a plasma column developing in the meanwhile in the tubular element 21.

Note that the device 1 object of the present invention does not need the presence of an ampoule connected to the hollow element 5. As a consequence, the device 1 is scarcely bulky, easy to produce and mechanically resistant.

Unless the contrary is explicitly indicated, the content of the references (articles, books, patent applications etc.) cited in this text is herein completely recalled.

The invention claimed is:

1. A device for generating plasma and for directing an flow of electrons towards a target; the device comprising a hollow element which has a cavity and is designed to act as a cathode; a main electrode; a dielectric tubular element, which extends through a wall of the hollow element from the cavity to an external chamber; and an external element which is designed to act as an anode, is externally placed with regard to the hollow element and is exterior to and along the tubular element; the device being characterized in that it comprises further comprising an activation group which is electrically connected to the hollow element and can reduce the electric potential of the hollow element of at least 8 kV in less than 20 ns; the main electrode at least partially placed inside the cavity delimited by the hollow element element; wherein said hollow element is wholly made of a metal material and in that the main electrode extends through a wall of the hollow element, between the main electrode and the hollow element being interposed a ring of dielectric ceramic material, so that, in use, the activation group imposes a difference of potential between the hollow element and the main electrode and, as a consequence, an arc lights between an internal surface of the cavity and the main electrode, the plasma of the arch being particularly dense and expanding inside the tubular element and lighting the discharge of the canalized spark which on its turn, produces a high-energy flow of electrons.

2. The device according to claim 1, and comprising first resistive means electrically earthing the main electrode.

3. The device according to claim 2, wherein the first resistive means have a resistance higher than 100 Ohm.

4. The device according to claim 1, wherein the cavity contains rarefied gas at a pressure lower than or equal to $10^{-2}$ mbar.

5. The device according to claim 2, wherein the rarefied gas contained inside the cavity has a pressure from $10^{-2}$ mbar to $10^{-5}$ mbar.

6. The device according to claim 1, and comprising a potential maintenance group, which is electrically connected to the external element and is able to keep the electric potential of the external element substantially equal to or higher than zero.

7. The device according claim 6, wherein the potential maintenance group earths the electric potential of the external element.

8. The device according to claim 1, wherein the external element is shaped so that it is placed around the tubular element.

9. The device according to claim 1, wherein the activation group can emit an electric pulse with a global charge comprised between 0.16 mC and 0.5 mC in order to reduce the electric potential of the hollow element of at least 8 kV in less than 20 ns.

10. The device according to claim 1, wherein the activation group comprises a thyratron.

11. The device according to claim 10, wherein the activation group comprises capacitive means which are electrically connected to the one side to an anode of the thyratron and to the other side to the hollow element; and an electric feeder , which has a positive electrode electrically connected to the anode of the thyratron.

12. The device according to claim 1, and further comprising second resistive means, which have a resistance of at least 50 kOhm and are electrically connected between the hollow element and the earth.

13. The device according to claim 1, wherein the activation group comprises a magnetic pulse compressor or a Blumlein electric pulse generator.

14. An apparatus for applying on a substrate a specific material, the apparatus comprising an external chamber , a target made of a specific material and placed in the external chamber;

the apparatus being characterized in that it comprises a device as defined in claim 1, the cavity of the device and the external chamber communicating and containing gas at a pressure lower than $10^{-2}$ mbar; the device being able to direct an flow of electrons against the target so that at least a part of the specific material is removed from the target and settles on the support.

15. A method of applying a specific material on a support, the method comprising an emission step, during which a device, according to claim 1 directs an flow of electrons against a target with the specific material in order to remove at least a part of the specific material from the target and to direct it towards the support.

16. The device according to claim 1, wherein said hollow element has a substantially cylindrical shape having a substantially circular section and it is obtained by mounting two drilled plates which, once mounted, define respective walls of said hollow element.

* * * * *